US011945476B2

(12) United States Patent
Jenkins et al.

(10) Patent No.: US 11,945,476 B2
(45) **Date of Patent: *Apr. 2, 2024**

(54) RAILCAR COLD FORMED CENTER SILL WITH STIFFNESS ENHANCING STRUCTURE

(71) Applicant: JAC OPERATIONS, INC., Chicago, IL (US)

(72) Inventors: Douglas M. Jenkins, Commodore, PA (US); Gregory P. Josephson, Salix, PA (US)

(73) Assignee: JAC OPERATIONS, INC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/737,322

(22) Filed: May 5, 2022

(65) Prior Publication Data

US 2022/0258775 A1 Aug. 18, 2022

Related U.S. Application Data

(62) Division of application No. 16/690,446, filed on Nov. 21, 2019, now Pat. No. 11,338,831.

(60) Provisional application No. 62/770,284, filed on Nov. 21, 2018.

(51) Int. Cl.
*B61F 1/02* (2006.01)
*B61F 1/08* (2006.01)

(52) U.S. Cl.
CPC . *B61F 1/02* (2013.01); *B61F 1/08* (2013.01)

(58) Field of Classification Search
CPC ..... B61F 1/02; B61F 1/08
See application file for complete search history.

(56) References Cited

U.S. PATENT DOCUMENTS

| | | | | |
|---|---|---|---|---|
| 1,360,774 | A | 11/1920 | Mooney | |
| 1,456,203 | A | 5/1923 | Weaver | |
| 1,881,797 | A | 10/1932 | Martin | |
| 2,082,792 | A | 3/1934 | Dean | |
| 2,125,690 | A | 8/1938 | Ragsdale | |
| 2,125,692 | A | 8/1938 | Ragsdale | |
| 2,620,751 | A | 12/1952 | Watter | |
| 3,538,857 | A | 11/1970 | Mowatt-Larssen | |
| 4,493,266 | A | 1/1985 | Augustine | |
| 4,770,018 | A | 9/1988 | Bosi | |
| 5,369,758 | A | 11/1994 | Weiss | |
| 5,860,366 | A | 1/1999 | Lydic | |
| 6,119,345 | A | 9/2000 | Lydic et al. | |
| 6,769,366 | B1 | 8/2004 | Lydic et al. | |
| 7,478,599 | B1 | 1/2009 | Lydic et al. | |
| 11,338,831 | B2 * | 5/2022 | Jenkins | B61F 1/02 |
| 2020/0239043 | A1 | 7/2020 | Jenkins | |

* cited by examiner

*Primary Examiner* — Zachary L Kuhfuss
(74) *Attorney, Agent, or Firm* — Blynn L. Shideler; Krisanne Shideler; BLK Law Group

(57) ABSTRACT

A cold formed center sill configured for extending substantially the length of a railcar, wherein said center sill includes a top wall, a pair of side sections joined to the top wall by a pair of upper curved sections, bottom sections coupled to the side sections through curved connecting sections, wherein the center sill includes an upwardly extending stiffening longitudinal rib centered within the top wall.

13 Claims, 2 Drawing Sheets

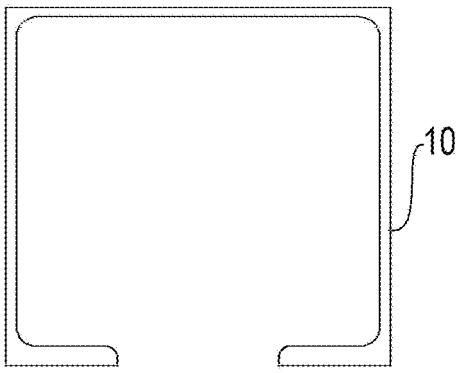
FIG. 1
PRIOR ART
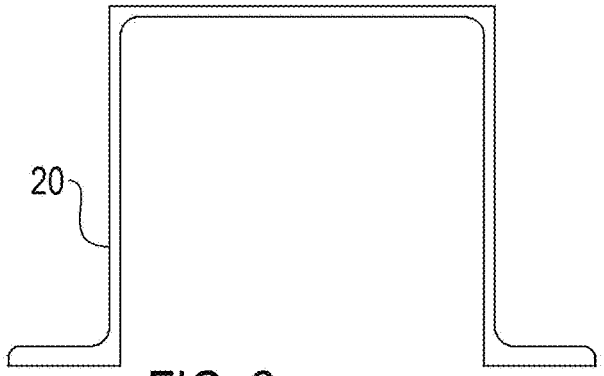
FIG. 2
PRIOR ART
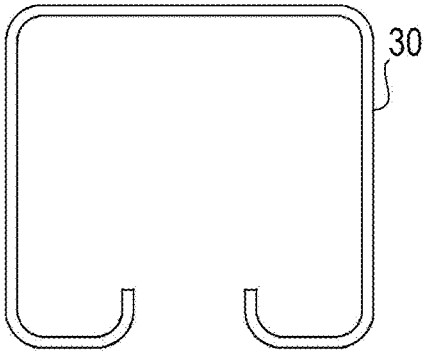
FIG. 3
PRIOR ART
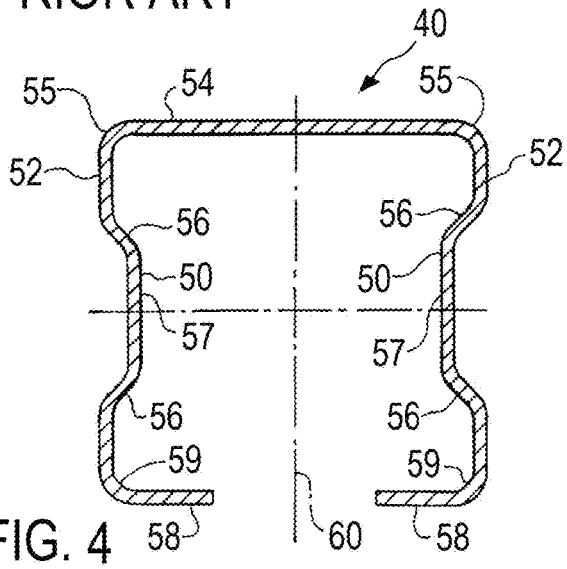
FIG. 4
PRIOR ART
FIG. 5
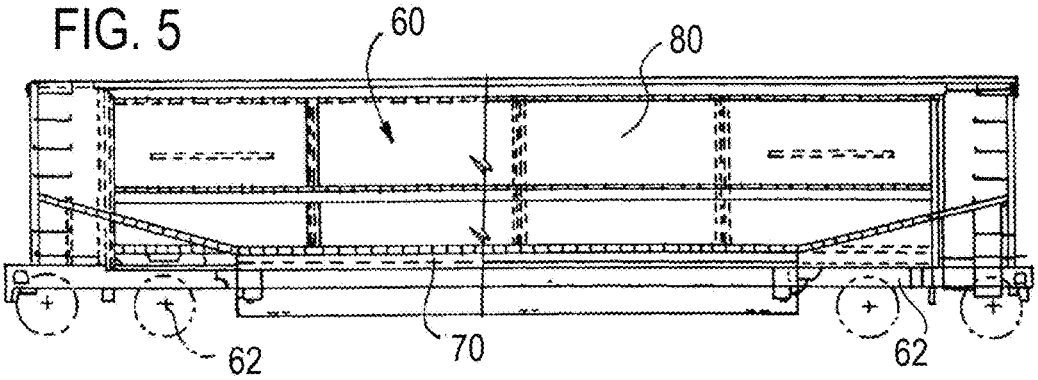

RAILCAR COLD FORMED CENTER SILL WITH STIFFNESS ENHANCING STRUCTURE

RELATED APPLICATIONS

The present application is a divisional of U.S. patent application Ser. No. 16/690,446 filed Nov. 21, 2019 and published Jul. 30, 2020 as Publication Number 2020-0239043 titled "Railcar Having Cold Formed Center Sill with Stiffness Enhancing Structure."

U.S. patent application Ser. No. 16/690,446 claims the benefit of U.S. Provisional Patent Application Ser. No. 62/770,284 filed Nov. 21, 2018 titled "Railcar Having Cold Formed Center Sill with Stiffness Enhancing Structure and Method of Forming the Same"

BACKGROUND OF THE INVENTION

Field of the Invention

We, Douglas Jenkins and Gregory Josephson have developed this invention which relates in general to railroad cars and more specifically, to a railcar cold formed center sill and its method of manufacture.

Background Information

The center sill is the primary structural member of the underframe of a rail car, and has been called the backbone or spine of the car body. A railcar center sill is subjected to the buff and draft forces created during operation of the rail car and generally extends as a continuous member along the length of the car body.

Historically, center sills have possessed many different cross-sectional configurations depending on the type of rail car and other considerations. One common configuration is the C center sill 10, the profile of which is shown in FIG. 1. Another historically common design is the hat or Z center sill 20, the profile of which is shown in FIG. 2. The Z designation was derived from the shape of the two components that were known to be coupled to form the structure.

Regardless of its particular shape, many prior art center sills were fabricated together from two or more hot formed sections in labor intensive processes. These historical hot formed processes yielded deviations in the straightness or acceptable tolerances of the center sill being formed that often resulted in further physical steps being needed to finish the center sill unit and conform it to acceptable tolerances in camber, sweep and twist to be suitable for use in a railroad car. The traditional welded center sill is an inherently heavy structure due to its design and fabrication technique.

In the 90s, attempts were made to address the deficiencies of the prior art center sill and a cold formed center sill 30 was developed as described in U.S. Pat. Nos. 7,478,599, 6,769,366 and 6,119,345 which are incorporated herein by reference. The cold formed center sill 30 disclosed therein has been successfully utilized since around 1996 and has yielded significant advantages. A conventional commercial cold formed, specifically cold rolled, center sill 30 profile is shown in FIG. 3.

Despite the acceptance of the conventional cold formed center sill 30 there were concerns raised about the inherent stiffness of the cold formed product as a whole. One theoretical proposal for addressing this was the inclusion of a pair of longitudinal inwardly extending stiffeners in a configuration of a cold formed center sill 40 shown in FIG. 4.

The proposed cold formed center sill 40 profile was also similar to the conventional and commercially available cold rolled shape 30 but further includes a pair of inwardly disposed ribs 50 rolled out of the two side sections for webs 52 of the center sill 6*c*. The inwardly directed longitudinal ribs 50 were designed to serve as stiffeners for the elongated center sill and were intended to be cold formed during the rolling process. The proposed center sill 40 includes a top wall 54 which is oriented at 90 degrees to side sections 52 by a curved portion 55 having an approximate radius, for example, of 15/16 inch and the like. The ribs 52 include inwardly extending connecting portion 56 of a length less than an inch and have a flat internal wall 57 to rigidize the center sill. The connecting portions 56 are also worked hardened as are curved portions 55. The bottom of the center sill includes a pair of partial horizontal bottom sections 58 integral to side sections 52 by curved sections 59. The bottom sections define longitudinal bottom opening 60 along the center sill 6*c*.

The cold formed center sill 40 design with the inward extending ribs 50 did not prove to be commercially successful or readily producible. In theory this design yielded improved stiffness, but the costs of production creating the rolling mills for this shape were too high for commercial feasibility outweighing the increase in theoretical operation.

Thus there is a need for cold formed center sills with stiffness enhancing structures that may be manufactured in a cost effective manner so as to be commercially acceptable and railcars incorporating the same.

SUMMARY OF THE INVENTION

The object of the present invention is achieved according to one embodiment of the present invention by providing a cold formed center sill configures for extending substantially the length of a railcar, wherein said center sill includes a top wall, a pair of side sections joined to the top wall by a pair of upper curved sections, bottom sections coupled to the side sections through curved connecting sections, wherein the improvement comprises an upwardly extending stiffening longitudinal rib centered within the top wall.

The features that characterize the present invention are pointed out with particularity in the claims which are part of this disclosure. These and other features of the invention, its operating advantages and the specific objects obtained by its use will be more fully understood from the following detailed description and the operating examples.

DESCRIPTION OF THE PREFERRED EMBODIMENTS

FIG. 1 is a side elevation section view of a prior art C-shaped center sill;

FIG. 2 is a side elevation section view of a prior art Hat or Z-shaped center sill;

FIG. 3 is a side elevation section view of a prior art cold formed center sill;

FIG. 4 is a side elevation section view of a proposed prior art cold formed center sill with internal ribs;

FIG. 5 is a side elevation view of a railcar having cold formed center sill with stiffness enhancing structure according to one embodiment of the present invention;

Figure 8A:
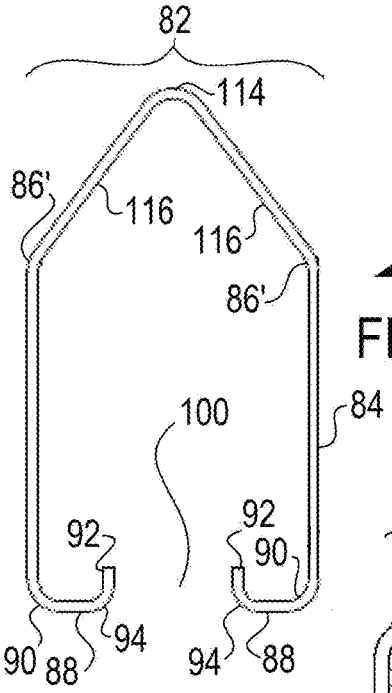
Figure 8B:
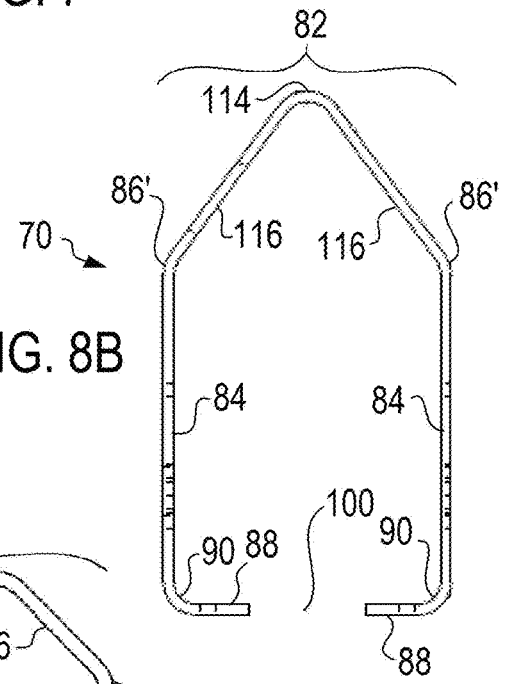
Figure 9:
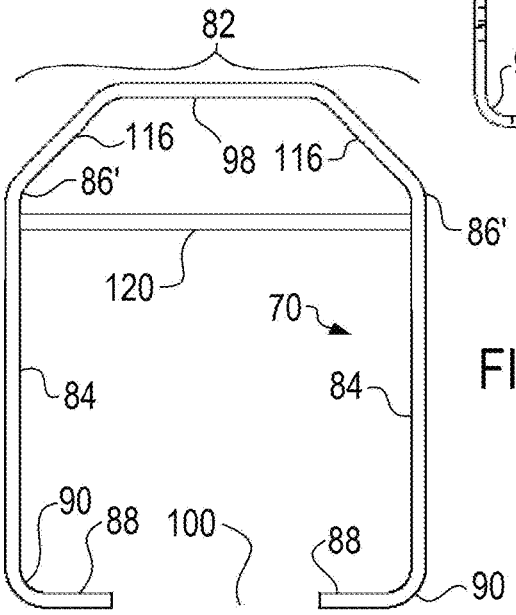

FIGS. 8A and 8B are a side elevation section views of a cold formed center sill with stiffness enhancing structure according to another embodiment of the present invention usable with the railcar of FIG. 5; and FIG. 9 is a side elevation section view of a cold formed center sill with stiffness enhancing structure according to another embodiment of the present invention usable with the railcar of FIG. 5.

DESCRIPTION OF THE PREFERRED EMBODIMENTS

Referring to FIG. 5, there is illustrated a railroad gondola car 60 for carrying commodities such as coal, gravel and the like and having an underbody carried by opposed truck assemblies 62. The underbody of the railroad car 60 of the invention includes a continuous cold formed center sill 70 with stiffness enhancing structures according to the present invention and which is extending substantially the entire length of the car 60:

A railcar body 80 is attached to the underframe. As will be apparent from the following description, the cold formed center sills 70 of several embodiments of the invention provide significant advantages over prior center sills and contribute to a lightweight, economical car design. Although the center sills 70 of the invention are shown with reference to the gondola car of FIG. 5 by way of illustration, it is within the scope of the invention to use the center sill 70 herein disclosed with any type or design of railcar in which the advantages of the invention are desired. Essentially any railcar having a through center sill (not a stub sill) could utilize the center sill 70 of the present invention.

The cold formed center sills 70 of the present invention with stiffness enhancing structures will generally increase in weight over a cold formed center sill 30 of the same grade and thickness and profile not having the stiffness enhancing structures, however the benefits of including the stiffness enhancing structures outweigh the extra weight of the sill 70 itself. Increasing the stiffness of the center sill 70 over an analogous sized sill 30 will allow the center sill 70 of the invention to absorb more of the coupler load and uniformly transfer this higher load to the next railcar, thereby minimizing the forces to be carried in the extraneous structural members of the railcar 60 like the side sill and other structures, thereby allowing for overall weight reduction to the car due to substantial weight savings in extraneous components.

Figure 6:
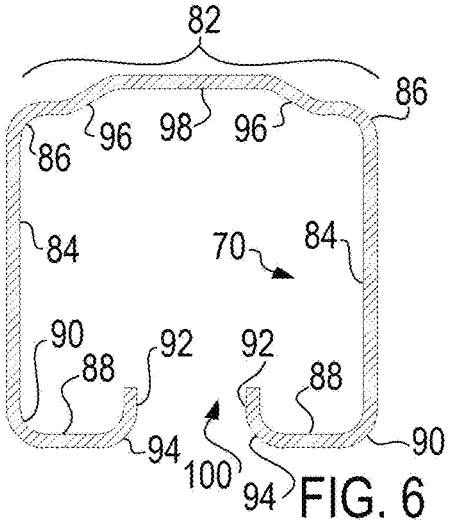
FIG. 6 is a side elevation section view of a cold formed center sill with stiffness enhancing structure according to one embodiment of the present invention usable with the railcar of FIG. 5.

In FIG. 6 is illustrated the first embodiment of the cold formed center sill 70 including stiffness enhancing structures of the invention. The center sill 70 is formed from suitable steel by a cold forming process. The process may be a cold rolling process through a series of rolling mills, or alternatively the shape may be made in two pieces joined together with each steel member being formed on a hydraulic brake or press. The center sill 70 may thus be formed in a generally rectangular configuration from one or two flat one-piece plate or coiled sheet of steel and the center sill 70 is continuous along its length. The center sill 70 is formed by bent sections created in the cold forming process from a material having a thickness of between ¼ up ¾" with ⅜ inch to ⅝ inch being preferable, and 0.4-0.5" being most preferred. The center sill 70 according to this embodiment includes an upper top wall 82 and a pair of flat side sections or webs 84, each of generally constant thicknesses.

The top wall 82 and pair of side sections or webs 84 are joined together at right angles by upper curved sections 86 being formed about a common radius such between about 0.75 and 1" radius. The bottom sections 88 of the center sill 70 are inwardly formed horizontally at right angles to the side sections 84 through curved connecting sections 90 being of constant radius between about 0.75 and 1" radius. The bottom sections 88 terminate in a pair of upright internal flange portions 92 extending upward and being joined to bottom portions by curved sections 94 of constant radius. Spaced between the internal upright flanges is a longitudinal opening 100 through which access to a apace within the center sill 70 is provided. By way of example, the bottom sections 88 forming the bottom portions of the center sill 70 may each extend approximately 4 inches from the side sections 84 with the opening 100 sufficient to receive a huck gun therein for assisting railcar manufacturing. The center sill 70 is preferably formed of steel having an average yield strength throughout its length of 50,000 to 80,000 PSI. The stiffening structures in the center sill 70 of the present invention more easily accommodates use of 50,000 PSI to be utilized, however the use of higher PSI steels can yield great weight savings for the overall railcar 60. For other reasons the 50,000 PSI is often generally preferred by customers in the industry, although weight savings is also desired, so the selected PSI of the steel remains a tradeoff.

The curved sections 86, 90, 94 are cold worked numerous times during the cold rolling process. As a result, the material is cold hardened and strengthened at sections as compared to its original unformed state. The resulting cross section does not require thicker sections or added material as in the prior art C shaped and Z shaped center sills 10, 20 and provides a high-strength member.

The key feature of the present invention is the provision of an outwardly or upwardly extending offset or stiffening longitudinal rib centered within the top wall 82. The offset includes a left and right transition segment 96 extending to a central flat land 98 generally aligned with the opening 100 and wider than the opening 100. The offset is a stiffening structure that increases the overall height of the center sill 70 to 13.938" and the overall density of the center sill 70 is 82.3 lbs/ft with 0.5" thickness steel. This compares with 78.4 lbs/ft for a conventional cold rolled center sill 30 of 0.5" thick steel of 12.938". The offset increases the bounded area or envelope of the center sill 70 that tends to improve resistance to buckling. For example in a 0.4" thick steel version of this embodiment of the present invention the envelope or bounded area is 18.9503 square inches and the conventional envelope of the same thickness (without the stiffener or offset) is 18.7583 square inches. The offset yields, for this particular configuration, greater than 1% increase in the bounded envelope and an associated increase in resistance to buckling forces.

The center sill 70 of the present invention was compared with a prior art cold formed center sill 30 and a C center sill 10 and a Z Center Sill 20. Each center sill 70, 30, 10, 20 was analyzed using 1" tetrahedron shaped elements in ANSYS brand software. Remote displacements were placed at each end of the center sill 70, 30, 10, 20 and a downward force of 1000 lbs was applied to the top surface. The maximum stress and maximum deflection are presented in the table below for each center sill 70, 30, 10, 20, along with the weight per foot.

| | Stress (psi) | Deflection (in) | Weight (lbs/ft) |
|---|---|---|---|
| Standard RF Center Sill | 18,988 | 2.38 | 78.4 |
| C Center Sill | 15,384 | 2.05 | 82.5 |
| Z Center Sill | 15,304 | 2.05 | 82.5 |
| New RF Center Sill | 15,974 | 2.04 | 82.3 |

As noted in the analysis above, the deflection of the center sill 70 of the present invention is less than that of the standard cold formed center sill 30 and is actually better than the conventional C center Sill 10 or Z Center Sill 20 of similar thickness (0.5" plate). Additionally the weight per foot is less than the conventional C Center Sill 10 and Z Center Sill 20, although not as light as the conventional cold formed center sill 30. The center sill 70 of the present invention still significantly reduces the weight of the overall railcar 60. Additionally the profile of the present invention can be efficiently formed and yields the improved results described above.

Figure 7:
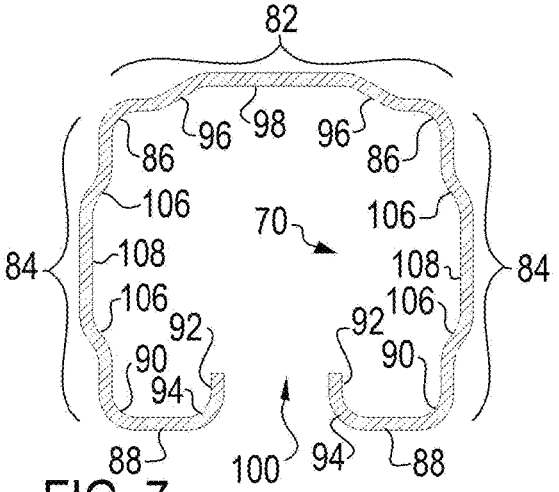
FIG. 7 is a side elevation section view of a cold formed center sill with stiffness enhancing structure according to another embodiment of the present invention usable with the railcar of FIG. 5.

A second embodiment of the center sill 70 including stiffness enhancing structures of the invention is shown in FIG. 7. The center sill 70 is formed from suitable steel by a cold rolling forming process, such as cold rolling or cold pressing. Cold pressing would be using two steel members in a hydraulic brake or series of brakes. The center sill 70 is formed by bent sections having a thickness as discussed above. The center sill 70 includes an upper top wall 82 and a pair of side sections or webs 84, each of generally constant thicknesses. The configuration exceeds the strength characteristics of the preceding embodiment for the same dimensions and material and is also preferably continuously formed from a one-piece coiled sheet or plate or as a two piece structure.

As with the first embodiment the top wall 82 and pair of side sections 84 are joined together at right angles by upper curved sections 86 being formed about a common radius. Similarly, the bottom sections 88 of the center sill 70 are inwardly formed horizontally at right angles to the side sections 84 through curved connecting sections 90 being of constant radius. The bottom sections 88 terminate in a pair of upright internal flange portions 92 extending upward and being joined to bottom portions 88 by curved sections 94 of constant radius. Spaced between the internal upright flanges 92 is a longitudinal opening 100 through which access within the center sill 70 is provided. The center sill 70 preferably possesses an average yield strength as discussed above.

Like the first embodiment of the present invention, a key aspect of the invention is the provision of an outwardly or upwardly extending offset or stiffening longitudinal rib centered within the top wall. The offset includes a left and right transition segment 96 extending to a central flat land 98 generally aligned with the opening 100 and wider than the opening 100. The offset is a stiffening structure that increases the overall height of the center sill 70 to 13.938".

The difference between the first embodiment and the second embodiment of the present invention is the inclusion of a pair of outwardly extending side offsets or stiffening longitudinal side ribs centered within each side wall 84. Each side offset includes a top and bottom transition segment 106 extending to a central flat land 108 generally centered on the side wall 84. The side offsets are stiffening structures that increases the overall width of the center sill 70 to 15.313" (from a conventional width of 13.813") and the overall density of the center sill 70 is 83.7 lbs/ft with 0.5" thickness steel. The increased weight is offset by an increased stiffness to the overall center sill 70 of this embodiment. The stiffening structures of this embodiment yields greater than 3% increase in the bounded envelope and an associated increase in resistance to buckling forces.

A third embodiment of the center sill 70 including stiffness enhancing structures of the invention is shown in FIGS. 8A and 8B, with the common features not described in detail again. In this embodiment the top offset is formed across the entire top 82 of the center sill 70 and mimics the shape of a center sill shroud with the transition elements 116 extending from a modified upper curved section 86' to a top central curved section 114. The upper curved sections 86' are modified in that each couples a side 84 to the transition elements 116 and not to a perpendicular member as in earlier embodiments. Here the increase in bounded area may be about 5%. The weight of this design with 0.5" steel is 107.414 lbs/ft. An alternative center sill 70 to this third embodiment is shown in FIG. 8B and the difference is to eliminate the internal flanges 92 and the associated coupling 94 for weight savings, dropping the weight per foot to 103.308 lbs/ft for a 0.5" thick design:

A fourth embodiment of the cold formed center sill 70 of the present invention is shown in FIG. 9. In the fouther embodiment the stiffening structure is an offset extending across the entire top 82 as shown including transition elements 116 from modified corners 86' to the flat central land 98. This center sill 70 further includes a reinforcing plate 120 welded in the interior only adjacent the draft arm ends and extending for a few feet to stop about at the floor intersection.

In all of the center sills 70 of the present invention the top surface of the center sill is above the top surface of the draft arms due to the stiffening offset structure. Conventionally in the prior art center sill structures the top surface of the center sill is aligned with the top surface of the draft arm. The reinforcing plate 100 in the fourth embodiment is aligned with the top surface of the draft arm and can convey forces down to the floor intersection. The stiffening structures of this fourth embodiment yields greater than 2-4% increase in the bounded envelope and an associated increase in resistance to buckling forces.

The above discussion illustrates that the cold formed center sills 70 of the present invention offer significant advantages over the prior art center sills 10, 20 30 or 40 without detrimental drawbacks. It will be apparent to those of ordinary skill in the art that various changes may be made to the present invention without departing from the spirit and scope thereof. Consequently, the present invention is intended to be defined by the appended claims and equivalents thereto.

What is claimed is:

1. A cold formed center sill for extending substantially the length of a railcar, wherein said center sill includes a top wall, a pair of side sections joined to the top wall by a pair of upper curved sections, bottom sections coupled to the side sections through curved connecting sections, wherein the improvement comprises an upwardly extending stiffening longitudinal rib centered within the top wall, and wherein in the upwardly extending stiffening longitudinal rib centered within the top wall includes a left and right transition segment extending to a central flat land.

2. The center sill according to claim 1, wherein the central flat land is generally aligned with an opening defined between the bottom sections.

3. The center sill according to claim 2, wherein the central flat land is wider than the opening.

4. The center sill according to claim 3, wherein center sill is formed of 0.5" stainless steel and wherein the upwardly extending stiffening longitudinal rib centered within the top wall is a stiffening structure that increases the overall height of the center sill to 13.938" and the overall density of the center sill 70 is 82.3 lbs/ft.

5. The center sill according to claim 1, further including a pair of reinforcing plates welded in the interior only adjacent the draft arm ends and extending for a few feet to stop about at a floor intersection of the railcar.

6. The center sill according to claim 5, wherein the reinforcing plates are aligned with a top surface of an adjacent draft arm.

7. The center sill according to claim 6, wherein the reinforcing plates are configured to convey forces down to the floor intersection.

8. The center sill according to claim 6 further including a pair of a pair of outwardly extending longitudinal side ribs centered within each side wall.

9. The center sill according to claim 8, wherein each outwardly extending longitudinal side rib includes a top and bottom transition segment extending to a central flat land generally centered on the side wall.

10. The center sill according to claim 9, wherein the overall width of the center sill 70 is 15.313" and the overall density of the center sill 70 is 83.7 lbs/ft.

11. The center sill according to claim 1, further including a pair of a pair of outwardly extending longitudinal side ribs centered within each side wall.

12. The center sill according to claim 11, wherein the overall width of the center sill 70 is 15.313" and the overall density of the center sill 70 is 83.7 lbs/ft.

13. The center sill according to claim 1, wherein the upwardly extending stiffening longitudinal rib centered within the top wall is formed across the entire top of the center sill.

* * * * *